US012638242B2

(12) United States Patent
Phan et al.

(10) Patent No.: US 12,638,242 B2
(45) Date of Patent: May 26, 2026

(54) APPARATUS AND METHOD TO PREVENT SPLITTING OR RUPTURE IN FLUID COILS

(71) Applicant: Coil Master Corporation, Moscow, TN (US)

(72) Inventors: Long Phan, Memphis, TN (US); Christian Sorensen, Rossville, TN (US)

(73) Assignee: Coil Master Corporation, Moscow, TN (US)

( * ) Notice: Subject to any disclaimer, the term of this patent is extended or adjusted under 35 U.S.C. 154(b) by 0 days.

(21) Appl. No.: 18/127,455

(22) Filed: Mar. 28, 2023

(65) Prior Publication Data

US 2023/0235966 A1 Jul. 27, 2023

Related U.S. Application Data

(63) Continuation of application No. 17/120,761, filed on Dec. 14, 2020, now Pat. No. 11,644,247.
(Continued)

(51) Int. Cl.
*F28D 9/02* (2006.01)
*F28D 7/16* (2006.01)
(Continued)

(52) U.S. Cl.
CPC ..... *F28D 7/16* (2013.01); *F28F 9/02* (2013.01); *F28F 21/062* (2013.01)

(58) Field of Classification Search
CPC ..... F28D 7/16; F28D 1/0477; F28F 21/062; F28F 9/02; F28F 9/0231; F28F 21/067;
(Continued)

(56) References Cited

U.S. PATENT DOCUMENTS 3,028,149 A 4/1962 Pellmyr
3,086,372 A 4/1963 Barger et al.
(Continued)

FOREIGN PATENT DOCUMENTS

EP 2741046 A2 6/2014
KR 20070077158 A 7/2007
WO 0016023 A1 3/2000

OTHER PUBLICATIONS

International Search Report issued by ISA/EPO in connection with PCT/US2020/065031 on Mar. 31, 2021.
(Continued)

*Primary Examiner* — Harry E Arant
(74) *Attorney, Agent, or Firm* — Arnold & Porter Kaye Scholer LLP

(57) ABSTRACT

A fluid coil includes a tube bundle having a series of straight tubing runs and a series of return bends extending between and fluidically connecting ones of the straight tubing runs, an expansion header fluidically connected to at least some of the return bends and a polymeric material disposed in the expansion header. The polymeric material has an initial shape and is compressible to repeatedly expand and contract between a first volume in which water is present in the tube bundle and a second volume in which the water undergoes a phase change. Contraction of the polymeric material absorbs an increase in volume as the water undergoes the phase change to prevent stressing and rupture of the tube bundle and upon an opposite phase change, the polymeric material returns to its initial shape. The polymeric material
(Continued)

can be a pressurizable bladder. A system and method to prevent the rupture of a tube bundle in a fluid coil are also disclosed.

29 Claims, 8 Drawing Sheets

Related U.S. Application Data

(60) Provisional application No. 62/949,219, filed on Dec. 17, 2019.

(51) Int. Cl.
*F28F 9/02* (2006.01)
*F28F 21/06* (2006.01)

(58) Field of Classification Search
CPC ..... F28F 2255/02; F28F 2265/14; F28F 2009/0285
See application file for complete search history.

(56) References Cited

U.S. PATENT DOCUMENTS

| | | | | |
|---|---|---|---|---|
| 3,238,932 | A * | 3/1966 | Simpson | F01P 11/029 123/41.5 |
| 8,714,461 | B2 * | 5/2014 | Vafai | B01L 3/502746 165/81 |
| 2007/0207186 | A1 * | 9/2007 | Scanlon | B29C 55/26 623/1.42 |
| 2009/0044928 | A1 | 2/2009 | Upadhya | |
| 2013/0196375 | A1 * | 8/2013 | Strobbe | C12P 19/04 210/198.2 |
| 2017/0074606 | A1 * | 3/2017 | Cooney | F28F 27/00 |
| 2017/0082222 | A1 * | 3/2017 | Buvid | C09D 183/04 |

OTHER PUBLICATIONS

Written Opinion issued by ISA/EPO in connection with PCT/US2020/065031 on Mar. 31, 2021.
International Preliminary Report on Patentability issued by ISA/EPO in connection with PCT/US2020/065031 on May 17, 2022.

* cited by examiner

APPARATUS AND METHOD TO PREVENT SPLITTING OR RUPTURE IN FLUID COILS

CROSS-REFERENCE TO RELATED APPLICATION DATA

This application is a continuation of U.S. patent application Ser. No. 17/120,761, filed Dec. 14, 2020, titled, APPARATUS AND METHOD TO PREVENT SPLITTING OR RUPTURE IN FLUID COILS, which claims the benefit of and priority to Provisional U.S. Patent Application Ser. No. 62/949,219, filed Dec. 17, 2019, titled, APPARATUS AND METHOD TO PREVENT SPLITTING OR RUPTURE IN FLUID COILS, the disclosures of which are incorporated herein in their entireties.

BACKGROUND

The present disclosure relates to an apparatus and method to prevent fluid coils from splitting or rupturing due to the thermal expansion of liquid, such as water, in freezing conditions and in steam conditions.

It is well-known that during a phase change of water from liquid to solid, its volume expands as much as 10% or more (volumetric thermal expansion). In fluid systems, thermal expansion can exert immense stresses and pressure on equipment and structures. In the field of heating, ventilation, and air-conditioning (HVAC), finned tube heat exchangers or HVAC coils are often used for heating and cooling of air in which a fluid such as water (liquid) or steam (gas) is circulated inside a closed loop of coils to transfer heat between the fluid and the air. Coils carrying water that are exposed to ambient air at or below the freezing point of water (e.g., 0° C. or 32° F.) for a sufficient amount of time may freeze up causing extreme pressures within the coil system that can damage the coil assemblies. Likewise, coils subject to water to steam phase change can also be subject to extreme pressures. Subsequent to freezing and upon thawing of ice, or pressure due to steam, water can leak out through breaks or split areas in the coils, at, for example, return bends. Leakage can cause flooding, which may damage the HVAC systems, as well as other equipment and areas of buildings in the vicinity of the flooded zones. This can result in expensive repairs or equipment replacement, in addition to service downtime suffered from the freezing/flooding event. Leakage can also occur in steam coils that are subject to the expansion of water as it heats to undergoes phase change to steam.

To prevent freezing and damage to systems, freeze plugs, expansion relief headers with pressure relief valves, and other devices are known. For example, it is known to use pressure relief devices at return bends or headers that blow out in the event of a freeze event to prevent damage to coils. However, these devices are limited in providing maintenance-free service upon the aftermath of the blow-out of the plugs due to excessive pressures caused by tube freezing. Indeed, the pressure relief device once blown out require replacement and maintenance, and water can bleed through tube cracks and flood the surrounding areas even before it is realized that damage has occurred.

Another device uses expansion relief headers with pressure relief valves in conjunction with pressure and temperature sensors to detect dropping temperature and rising pressure around selected values in a freeze event. These assemblies then release an appropriate volumetric amount of water to prevent damage to the tubes and return bends. While these devices require less maintenance, they are costly and bulky due to the various sensors and valves added to the expansion relief headers.

In another device, round, hollow tubular inserts are affixed in a central position using guides within pressurized water pipes and water mains. The insert is constructed of a thin-walled, flexible material that is capable of being deformed, thereby absorbing expansion pressures exerted by the water in a frozen state. However, this device only functions in a conduit conveying or containing water that does not involve heat transfer between inner and outer environments of the conduit. Moreover, if used in fluid coils in HVAC applications, such inserts severely degrade the thermal-hydraulic performance of the coils. In addition, leaching of the flexible material into the fluid is also a concern when in direct contact with non-potable water that may carry various chemical impurities.

A similar device for freeze protection in fluid transport passages uses an annular passage formed between an insert made of a compressible elastomeric material and a rigid conduit. The device also introduces a substantially liquid impermeable membrane preferably disposed in substantially adjacent relationship with the insert. Such a device also fails in heat transfer applications as it directly adds an interference with a large thermal resistance inside the water conduit. In addition, although a liquid impermeable membrane is used to separate the insert from the fluid, the presence of the membrane reduces the hydraulic performance of the fluid system.

In still another system, an apparatus and method utilize a freeze protection material consisting of a closed cell, expanded polymeric material with specific properties that is configured to protect fluid systems. Although these materials can be free of zinc, silicon, sulfur, sodium, potassium, or halogens, so as not to interfere with chemical reactions in sensitive fluid systems through leaching of these elements into the surrounding fluids, it is possible that other chemical additives, such as chlorine, in water treatment systems for high temperature HVAC systems can accelerate leaching.

As such, many of the known freeze prevention devices and systems are disadvantageous for fluid coils in HVAC applications due to their limited capabilities in treated water systems, in exposure to a wide range of working temperatures, and in systems that use chemical additives. Moreover, many of these systems reduce the thermal-hydraulic performance due to, for example, direct contact of compressible materials with the working fluid in a fluid passage. In addition, some known freeze protection methods and devices/systems for fluid coils require either labor-intensive maintenance with potential flooding and/or large, expensive sensor systems that can complicate construction.

Accordingly, there is a need for a device to prevent fluid coils from splitting or rupturing due to the thermal expansion of liquid, such as water, in freezing conditions or when the liquid is heated and undergoes a phase change to steam. Desirably, such a device can be used in treated water systems, without the cooling system and device materials interacting with one another in deleterious ways. More desirably still, the device compresses to absorb the expansion volume of water in the system as it freezes to ice or changes phase to steam, and once the ices thaws or the steam condenses, it returns to it pre-compressed state.

SUMMARY

In one aspect, a fluid coil includes a tube bundle having a series of straight tubing runs and a series of return bends extending between and fluidically connecting ones of the straight tubing runs, an expansion header fluidically connected to at least some of the return bends, and a polymeric material disposed in the expansion header. The polymeric material has an initial shape and is compressible to repeatedly expand and contract between a first volume in which water is present in the tube bundle and a second volume in which the water undergoes a phase change. The phase change can be from water to ice or from water to steam.

Contraction of the polymeric material absorbs an increase in volume as the water undergoes a phase change to ice so as to prevent stressing and rupture of the tube bundle, and upon a phase change from ice to water or water to steam, the polymeric material returns to its initial shape.

In an embodiment, a suitable polymeric material is resilient and hydrophobic and can have a closed cell structure. The material can have a working temperature in a range of about −40° F. to about 250° F., and a Shore A hardness of about 50 to 90.

In an embodiment, the polymeric material is chemically resistant and non-reactive to chemicals used for corrosion control and/or microbial control. Suitable materials include, but are not limited to, an elastomer, a fluorocarbon, a perfluoroelastomer, ethylene-propylene, and tetrafluoroethylene/propylene, and combinations thereof.

In an embodiment, the fluid coil includes a fin pack and support members, such that the tube bundle and fin pack are mounted within the support members. In some embodiments the fluid coil includes a first plurality of return bends on a first side of the tube bundle and a second plurality of return bends on a second side of the tube bundle. The first plurality of tube bends extends between and fluidically connects ones of the straight tubing runs on the first side of the tube bundle and the second plurality of tube bends extends between and fluidically connects ones of the straight tubing runs on the second side of the tube bundle.

In embodiments, the fluid coil includes two expansion headers, a first expansion header fluidically connected to the first plurality of return bends and a second expansion header fluidically connected to the second plurality of return bends. In such an embodiment, an expansion header can be associated with each of the pluralities of return bends.

In embodiments, the polymeric material is a pressurizable bladder. The pressurizable bladder can be a tube, and can further include caps at ends of the tube to close off the tube. One of the caps can include a fitting for introducing a compressed gas into the tube.

One suitable material for the tube is EPDM rubber. The bladder can be pressurized to about 120 psi to 150 psi.

A system to prevent the rupture of a tube bundle in a fluid coil, which the fluid coil has a tube bundle having a series of straight tubing runs and a series of return bends extending between and fluidically connecting ones of the straight tubing runs, includes an expansion header fluidically connected to at least some of the return bends and a polymeric material disposed in the expansion header. The polymeric material has an initial shape and is compressible to repeatedly expand and contract between a first volume in which water is present in the tube bundle and a second volume in which the water undergoes a phase change to ice.

In embodiments, the compressible material is a pressurizable bladder. The bladder can be, for example a tube. The tube can include caps at ends of the tube to close off the tube. The tube can be affixed to the caps by clamps to seal the tube. One of the caps can include a fitting for introducing a compressed gas into the tube. One suitable material is formed from EPDM. The bladder can be is pressurized to about 120 psi to 150 psi.

Contraction of the polymeric material absorbs an increase in volume as the water undergoes a phase change to ice so as to prevent stressing and rupture of the tube bundle, and, upon a phase change from ice to water, the polymeric material returns to its initial shape.

A method to prevent the rupture of a tube bundle in a fluid coil, which fluid coil has a tube bundle having a series of straight tubing runs and a series of return bends extending between and fluidically connecting ones of the straight tubing runs, and an expansion header fluidically connected to at least some of the return bends, includes disposing in the expansion header a polymeric material having an initial shape, which material is compressible to repeatedly expand and contract between a first volume in which water is present in the tube bundle and a second volume in which the water undergoes a phase change to ice. In methods, contraction of the polymeric material absorbs an increase in volume as the water undergoes a phase change to ice to prevent stressing and rupture of the tube bundle, and, upon a phase change from ice to water, the polymeric material returns to its initial shape.

In methods, wherein the polymeric material is a pressurizable bladder. The pressurizable bladder can be a tube, and can including caps at ends of the tube to close off the tube. One of the caps can include a fitting for introducing a compressed gas into the tube. The tube can be formed from EPDM. In methods, the bladder is pressurized to about 120 psi to 150 psi.

Since the apparatus has no pressure relief valves, the fluid is kept inside the expansion headers without bleeding to the outside environment, which adds another level of protection to avoid system flooding. The apparatus is also presented without expensive sensors, so the cost is reduced significantly. The apparatus is equipped with an end cap that is threaded to the end of the expansion header for easy repair and maintenance, should the material need to be inspected or replaced.

Further understanding of the present disclosure can be obtained by reference to the following detailed description in conjunction with the associated drawings, which are described briefly below.

DESCRIPTION OF THE DRAWINGS

Various embodiments of an apparatus or system and method to prevent the splitting or rupturing of fluid-carry coils are disclosed as examples and are not limited by the figures of the accompanying drawings, in which like references may indicate similar elements and in which.

DETAILED DESCRIPTION

Figure 1:
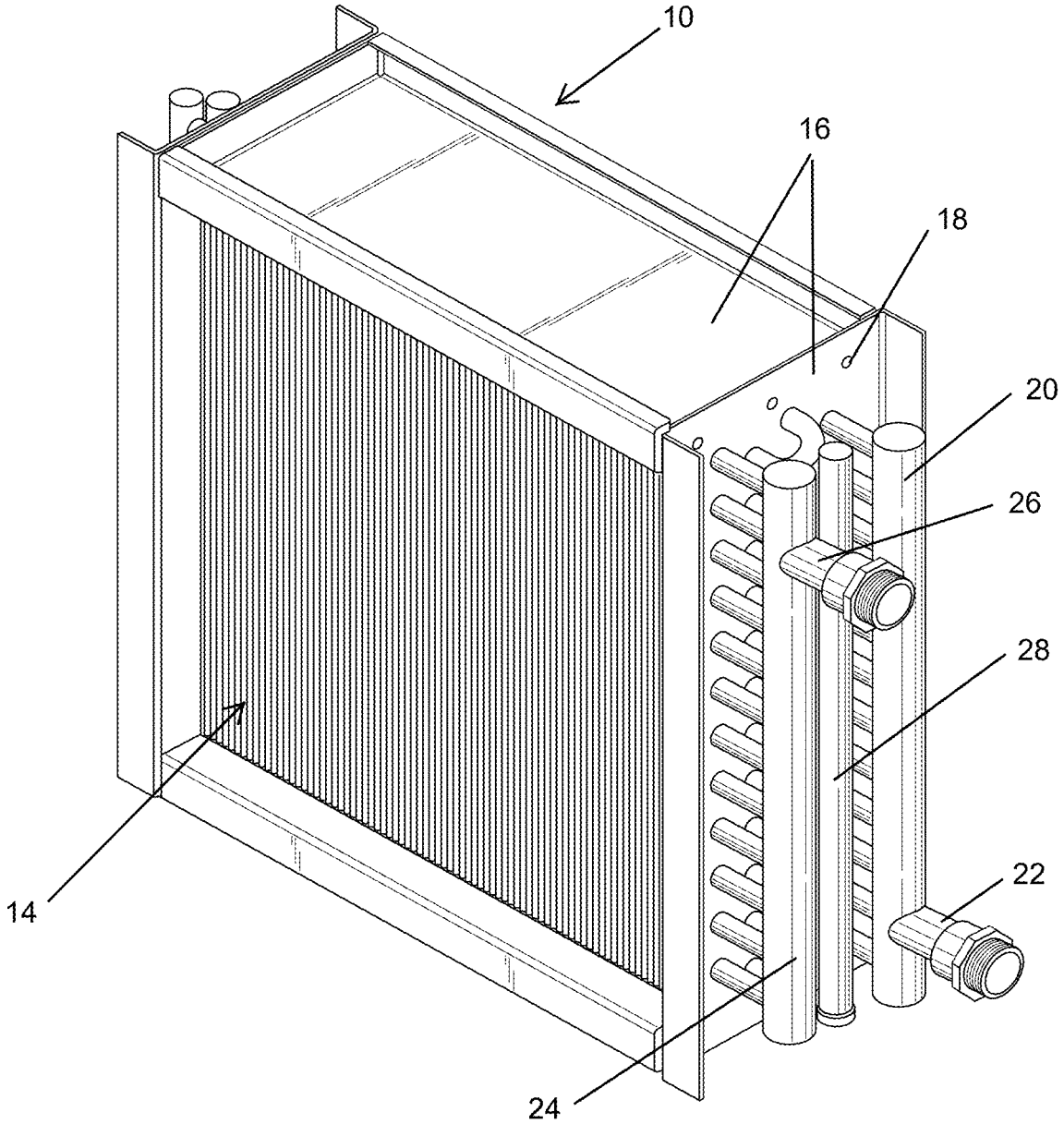
FIG. 1 is an isometric front view of an embodiment of a fluid coil having a system to prevent splitting or rupturing of the coil bundle in the event of a thermal event such as freezing or heating to steam, the illustrated fluid coil being a four-row fluid coil.
Figure 2:
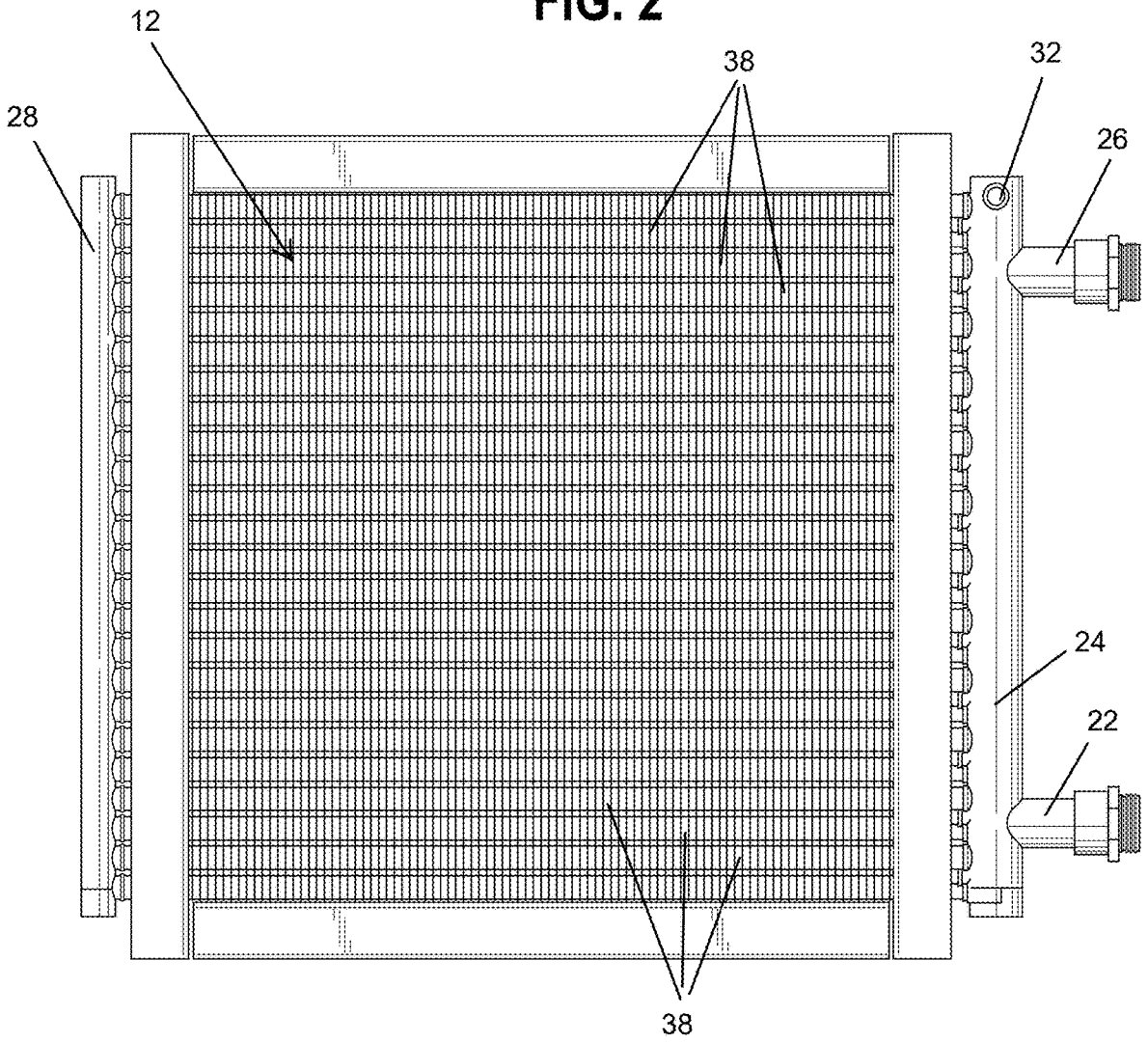
FIG. 2 is a sideview of the fluid coil.
Figure 3:
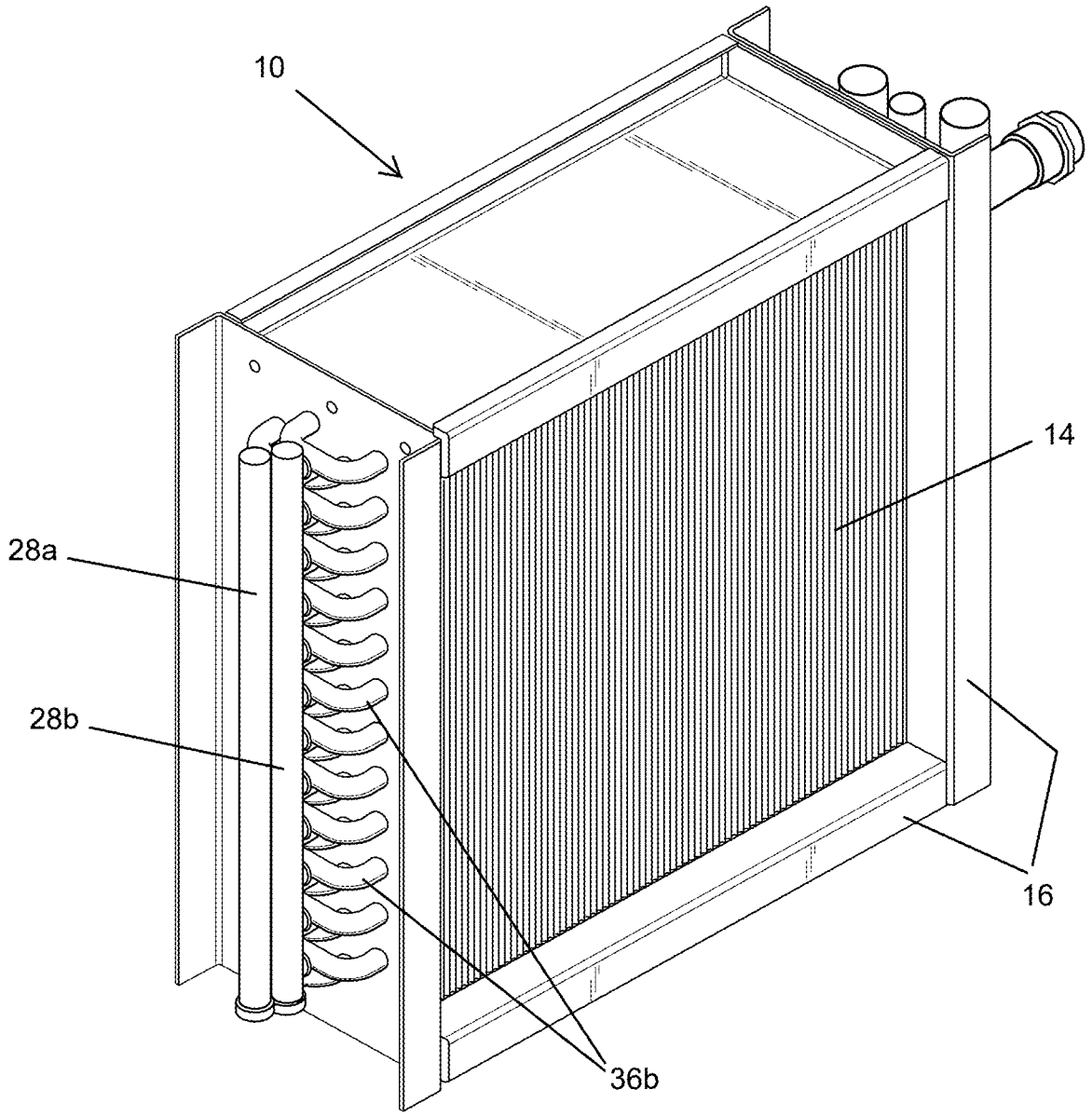
FIG. 3 is an isometric rear view of the fluid coil.
Figure 4:
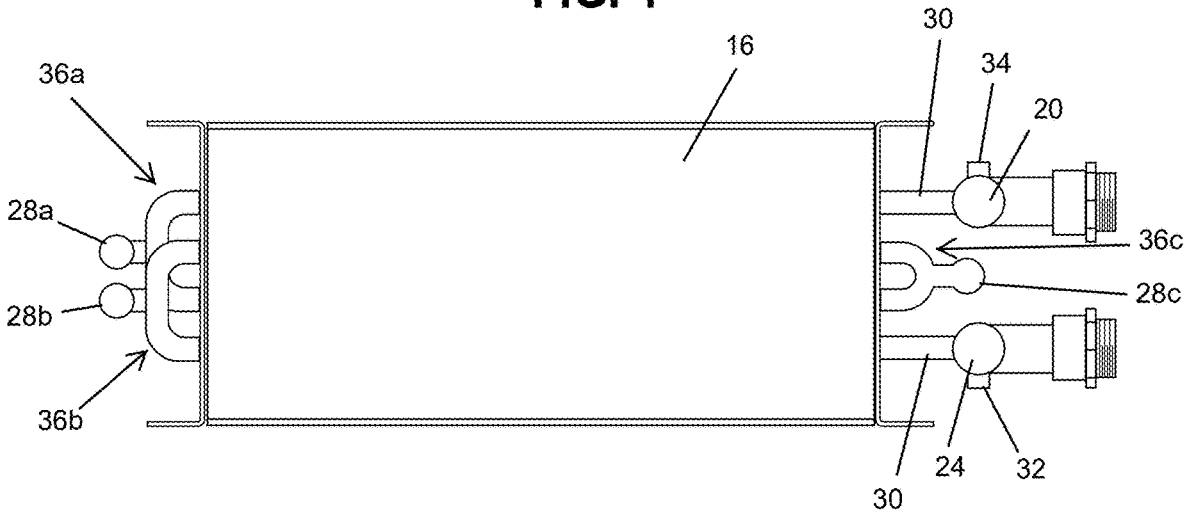
FIG. 4 is a top view of the fluid coil.
Figure 5:
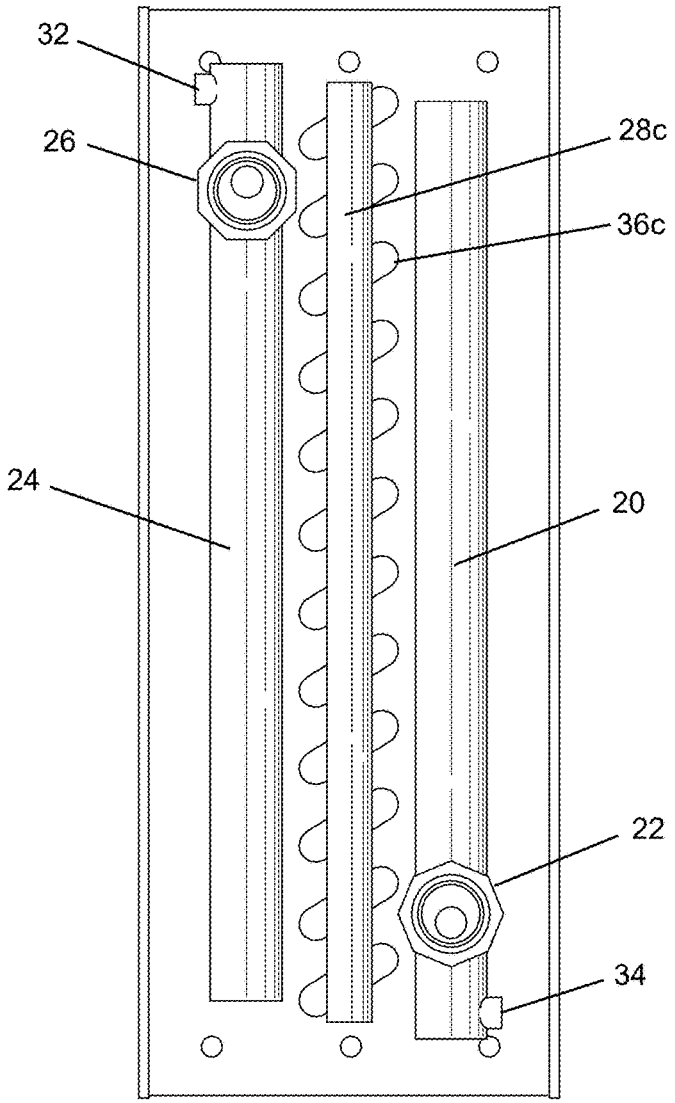
FIG. 5 is a front view of the fluid coil.

While the present disclosure is susceptible of embodiments in various forms, there is shown in the drawings and will hereinafter be described a presently preferred embodiment with the understanding that the present disclosure is to be considered an exemplification and is not intended to limit the disclosure to the specific embodiment illustrated.

A novel apparatus or system and method are disclosed to prevent the splitting or rupturing of fluid-carry coils in, for example, an HVAC system, due to the thermal expansion of water in freezing conditions or phase change from water to steam. The present disclosure provides an apparatus or system, and method that protect fluid coils from splitting or rupturing when a freeze or heating to steam event occurs. The present system and method reliably and repeatedly protect fluid coils from splitting or rupturing due to excessive stresses and pressure caused by expansion during a phase change of water to ice or water to steam inside fluid coils.

Referring to the figures there is shown a fluid coil 10 having a tube bundle 12 and a fin pack 14 mounted and secured to support members 16 by fasteners 18. The tube bundle 12 has an inlet header 20 with an inlet piping connection 22, an outlet header 24 with an outlet piping connection 26, and expansion headers 28, as will be discussed in more detail below. The inlet header 20 and outlet header 24 are connected to the tube bundle 12 by pipe extensions 30. An air vent 32 is located on an upper side of the outlet header 24 and a water drain 34 is located on the lower side of the inlet header 20.

The tube bundle 12 has a series of return bends 36 extending between and connecting straight tubing runs 38. In the illustrated fluid coil 10 there are two series of return bends 36*a*, 36*b* on one side of the bundle 12 and one series of return bends 36*c* on an opposite side of the bundle 12.

The expansion headers 28 are connected to their respective return bends 36 in each series of return bends 36. The expansion headers 28 are connected to the return bends 36 by header connectors 40. For example, in the illustrated fluid coil 10, expansion header 28*a* is connected to return bends 36*a* by header connectors 40*a*, expansion header 28*b* is connected to return bends 36*b* by header connectors 40*b*, and expansion header 28*c* is connected to return bends 36*c* by header connectors 40*c*.

For purposes of the present disclosure, the expansion headers 28*a*, 28*b* an 28*c* are referred to collectively by reference number 28, the return bends 36*a*, 36*b* and 36*c* are referred to collectively by the reference number 36 and the header connectors 40*a*, 40*b* and 40*c* are referred to collectively by reference number 40.

In an embodiment, the expansion headers 28 are closed at their ends 42 by caps 44. The caps 44 can be removable to inspect, repair or replace material 46 disposed in the expansion headers 28, which material 46 is described in more detail below. In embodiments the end 44 caps are threaded onto the expansion headers 28.

It is to be understood that reference to "connection" or "connected" in the present disclosure means fluidically connected so as to permit flow between and among the connected elements.

Figure 6:
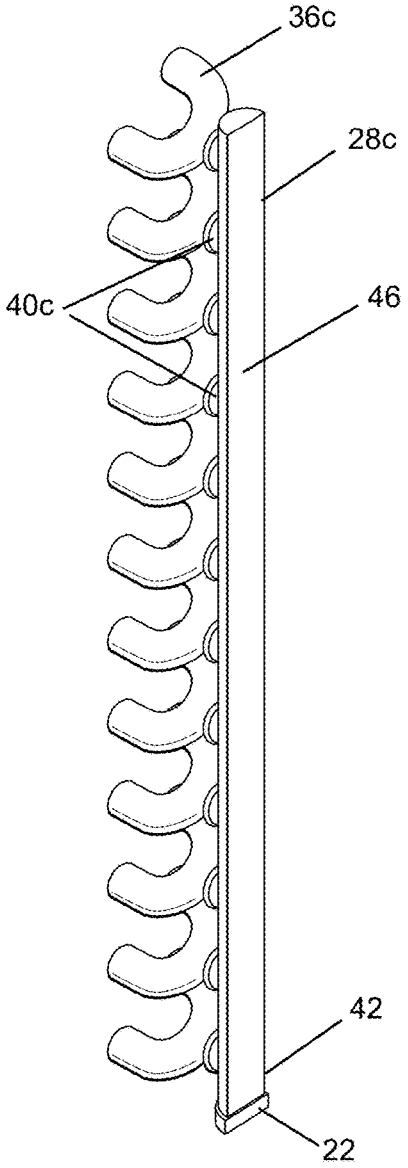
FIG. 6 is a partial cross-sectional view of the expansion header of FIG. 5, the expansion header shown filled with a compressible polymeric material.
Figure 7:
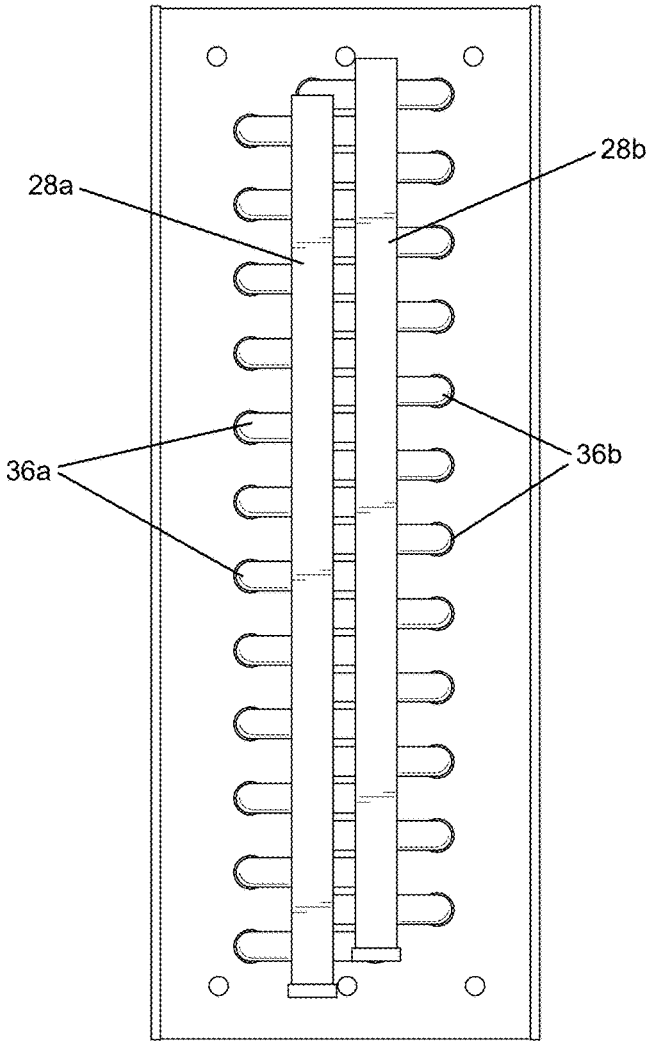
FIG. 7 is a rear view of the fluid coil.
Figure 8:
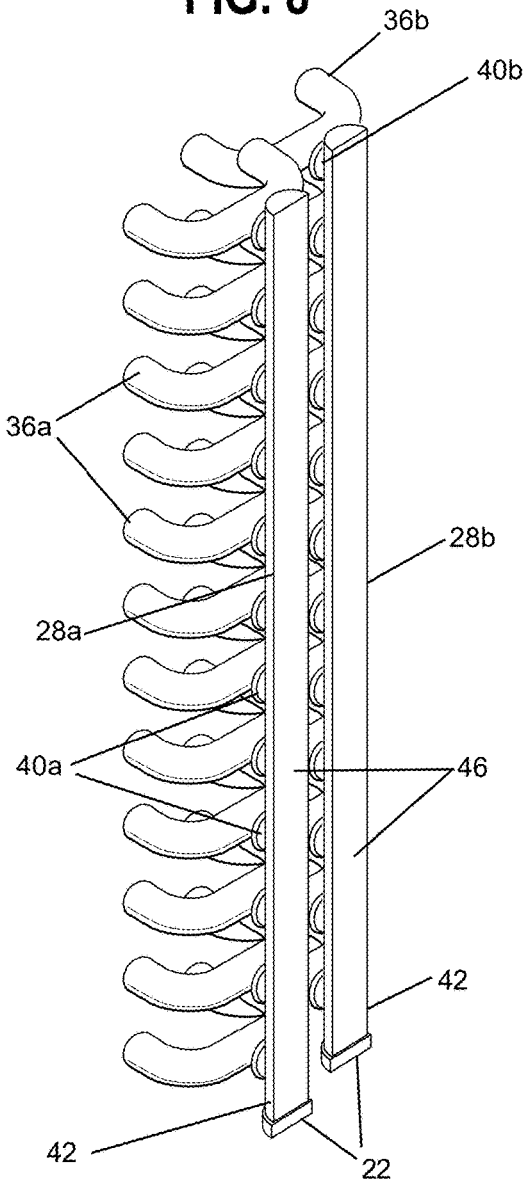
FIG. 8 is a partial cross-sectional view of the expansion headers of FIG. 6, the expansion headers shown filled with a compressible polymeric material.
Figure 9:
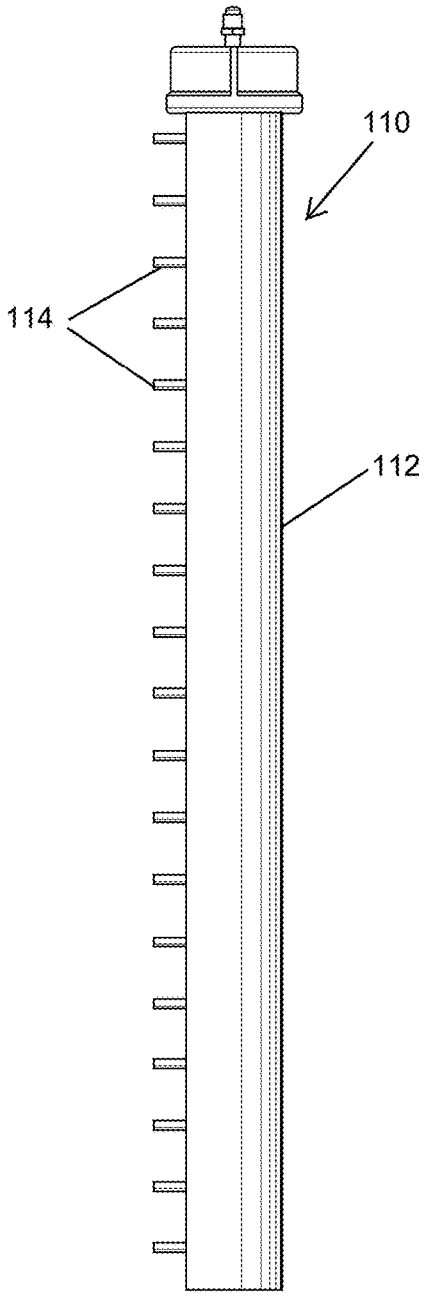
FIG. 9 illustrates another embodiment of the system to prevent splitting or rupturing of the coil bundle, showing the expansion header.
Figure 10:
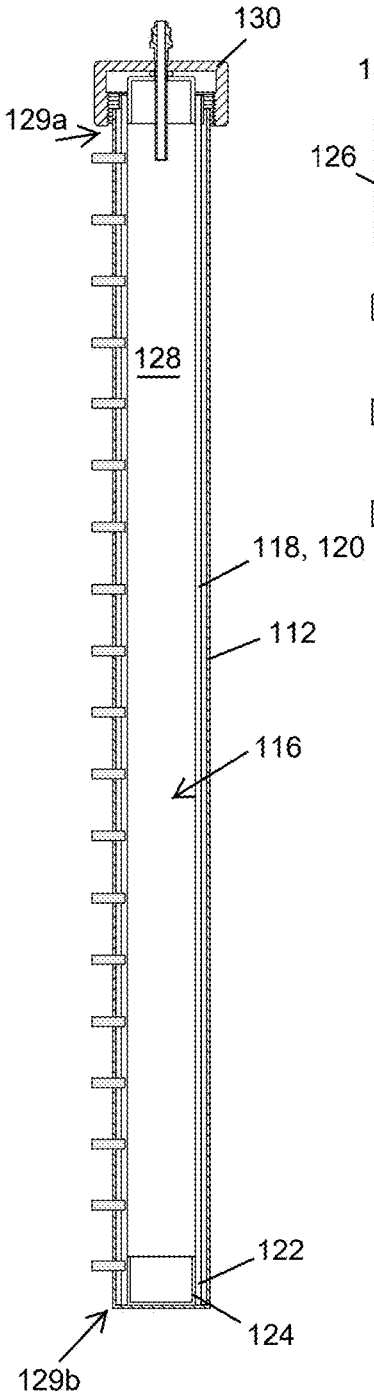
FIG. 10 is a sectional view of the expansion header of FIG. 9.
Figure 11:
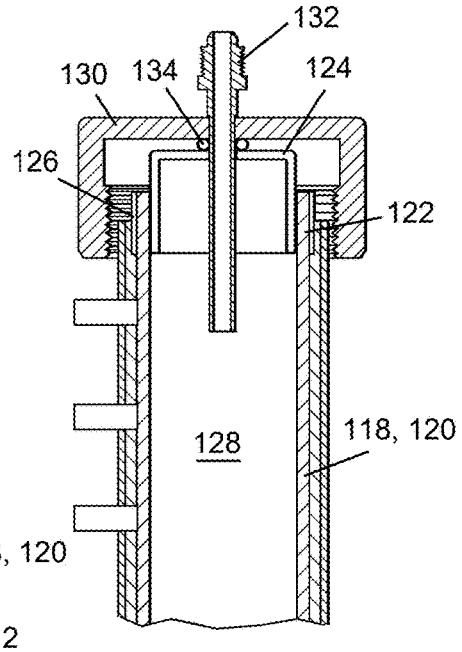
FIG. 11 is a partial section view of the upper portion of the expansion header of FIGS. 9 and 10.

Referring now to FIGS. 6 and 8, to absorb the expansion and contraction within the tube bundle 12, a high-quality, compressible material 46 is disposed in the expansion headers 28. The material 46 expands and contracts within a minimum volume and a maximum volume. The material 46, when contracted by the excessive expansion pressure caused by the phase change of water, e.g., freezing, allows the fluid (and ice) to volumetrically expand into a predetermined volume of the material 46 as the material 46 compresses, thus reducing the stresses and pressure on the tube bundle 12 to prevent splitting or rupturing of the tube bundle 12.

The material 46, upon thawing of the ice, expands to regain its original volume within a predetermined space of the expansion header 28. It is anticipated that the material 46 has an appropriate hardness so that in a normal liquid state of water, the material 46 maintains its original shape within the confined space of the expansion header 28. The material 46 also has an appropriate compression set property to reliably and repeatedly protect the fluid coil 12 from splitting or rupturing when the ambient air temperature is at or below the freezing point and water in the coil freezes or during a heating event and a phase change from water to steam.

The material 46 must be able to achieve the required expansion and contraction in freeze and thaw conditions, as well as during heating and phase change from water to steam. and the ability to retain its original shape following repeated expansions and contractions. That is, the material 46 is sufficiently resilient to return to its original shape with minimal or no deformation.

One suitable material 46 is a polymeric material that is water resistant or hydrophobic, and has a closed cell structure. To function well in the HVAC environment, the material 46 should have a working temperature in a range of about-40° F. to about 250° F. It should be resilient and be able to withstand reliably and repeatably expand and contract for long and short periods of time. And, when expanded, the material 46 should return to its original shape and volume.

The material 46 should also be sufficiently hard so that it maintains it shape when in contact with water at temperatures up to at least about 250° F. and a working pressure of up to about 250 pounds per square inch (psi) beyond which it will deform. A presently contemplated, suitable hardness is a Shore A hardness of about 50 to 90.

The material 46 should also be chemically resistant and/or non-reactive when, for example, used in water cooling/heating systems. Such systems may use a variety of chemicals to, for example, control corrosion, such as sulfites, orthophosphates, nitrites, molybdates, silicates, zinc, polyphosphates, phosphonates, triazoles, azoles and others. Systems may also use a variety of chemicals for microbial control, such as oxidizing biocides (e.g., chlorine, bromine, chlorine dioxide, glutaraldehyde liquid micro biocides, and ozone), and non-oxidizing biocides (e.g., isothiazolin, glutaraldehyde, dibromo-nitrilopropionamide (DBNPA), carbamate, quaternary amines, and terbuthylazine). In addition, the material 46 should be chemically compatible with such chemistry/chemicals to reduce leaching concerns. Other chemicals/chemistry for use in water cooling/heating systems will be recognized by those skilled in the art.

Some suitable materials 46 include, for example, elastomers such as fluorocarbons, such as VITON® (commercially available from DuPont Performance Elastomers), FLUOREL® (commercially available from 3M Company) and TECHNOFLON® (commercially available from Solvey Solexis, USA), perfluoroelastomers such as CHEMRAZ® (commercially available from Green, Tweed & Co.), KALREZ® commercially available from DuPont Performance Elastomers, and TECHNOFLON PFR® (commercially available from Solvey Solexis, USA), ethylene-propylene such as NORDEL® (commercially available from Dow Chemical), KALTAN® (commercially available from DSM Elastomers), and ROYALENE® (commercially available from Chemtura Corporation), and tetrafluoroethylene/propylene, such as ALFAS®, (commercially available from Asahi Class Co., Ltd.), and TBR® (commercially available from DuPont Performance Elastomers). Other classes of materials 46 and materials that provide the desired operational and performance characteristics will be recognized by those skilled in the art and are within the scope and spirit of the present disclosure.

It is also anticipated that the material 46, at room temperature and pressure, will fill the expansion headers 28, although there may be some embodiments in which an air or fluid space is present in the headers 28 when the material 46 is disposed in the headers 28.

It is also anticipated that in some embodiments monitoring systems are incorporated into the fluid coil 10. For example, thermistors, such as NTC thermistors or other temperature sensing devices can be mounted in, on or to the fluid coil 10 at, for example, the caps 44. Other monitoring and/or sensing devices can likewise be incorporated in the fluid coil 10.

It will be appreciated that because embodiments of the apparatus or system does not require the use of pressure relief valves, fluid is kept inside the fluid bundle 12 (and the expansion headers 28) without bleeding to the outside environment, which adds another level of protection to avoid system and surrounding area flooding.

Another embodiment of a system 110 to prevent the rupture of a tube bundle 12 in a fluid coil 10 is illustrated in FIGS. 9-12. Similar to the system of FIGS. 1-8, the system 110 is used to prevent the splitting or rupturing of fluid-carry coils in, for example, HVAC systems, due to the thermal expansion of water in freezing conditions. The system 110 includes one or more expansion headers 112 that are connected to return bends in the coil 10 by header connectors 114. The headers 112 include a compressible member 116, and in an embodiment, a pressurizable, expandable bladder 118. In an embodiment the bladder 118 is a polymeric tube 120, for example an ethylene propylene diene monomer (EPDM) rubber tube 120. The tube 120 is formed from a material that is compatible with the fluid system in which it is used. Other materials will be recognized by those skilled in the art.

The tube 120 is sealed at both ends 122. In an embodiment tube caps 124, such as copper tube caps are positioned in the tube ends 122. A clamp 126 is positioned on each tube end 122 overlying the tube 120 and the tube cap 124 to seal each end 122. The tube caps 124, sealed to the tube 120 define an interior pressurizable volume 128.

In an embodiment, one end 129*a* of the header 112 is sealed and the other end 129*b* is closed by a header cap 130. In an embodiment, the header cap 130 is a steel cap, such as a galvanized cap, so as to minimize any galvanic interaction between or among the materials. The header cap 130 encloses the bladder 118, tube caps 124 and clamps 126 in the header 112.

To pressurize the bladder 118, a fitting 132, such as a gas fitting, is positioned through the header cap 130 and its adjacent tube cap 124, and extends into the pressurizable volume 128. The fitting 132 can be mounted to the tube cap 124 by, for example brazing and the like. The fitting 132 can be, for example, a threaded pipe nipple. Other methods to mount the fitting 132 to the tube cap 124 will be recognized by those skilled in the art. A seal 134, such as an O-ring can be positioned about the fitting 132, between the tube cap 124 and the header cap 130.

It is contemplated that the bladder 118 is pressurized to a predetermined pressure to function to accommodate the expanded volume as the water freezes to ice or water undergoes a phase change to steam. It is anticipated that the bladder 118 will be pressurized or charged to about 120 to about 150 psi. As the water in the coil 10 assembly freezes, it will expand into the expansion header 112 and compress the bladder 118 externally—that is the ice will expand into the space between the header 112 and the bladder 118. Likewise, in heating events, as the water undergoes a phase change from water to steam, it will expand into the space between the header 112 and the bladder 118. The bladder 118 compresses (thus reducing its volume) and the pressure in the bladder 118 increases to accommodate the decrease in the bladder's volume (the differential volume of ice and water) during a freezing event. As the ice thaws, the bladder 118 will return to its original volume by forcing the lower volume water back into the coil assembly 10.

Figure 12:
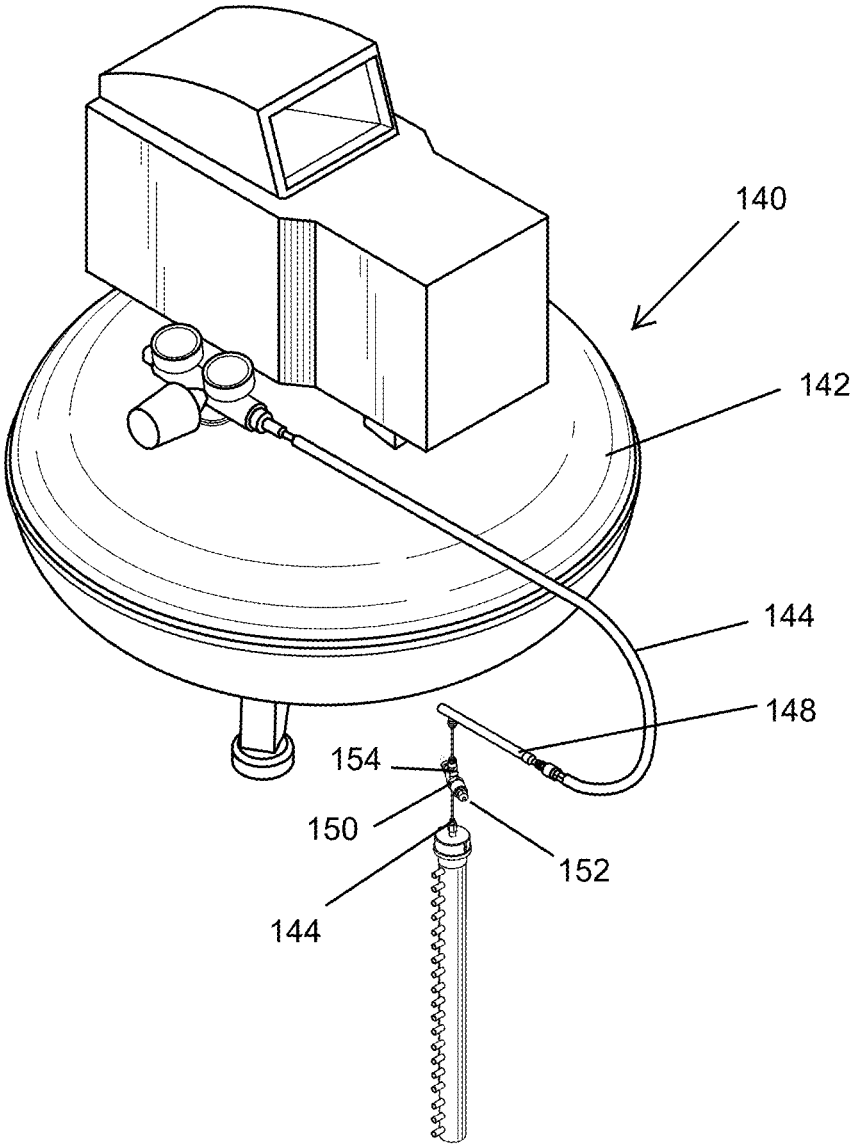
FIG. 12 is an illustration of a feed and control system for the apparatus to prevent fluid coils from splitting or rupturing due to the thermal expansion of liquid.

A system 140 to pressurize the bladder 118 is illustrated in FIG. 12. The system 140 includes a source 142 of compressed gas, such as compressed air. In the illustrated system 140, a compressor and storage tank are illustrated. It will be appreciated that other sources 142 of compressed gas can be used and are within the scope and spirit of the present disclosure.

The system 140 includes flow conduits 144, such as tubing, between the source 142 and the fitting 132. In an embodiment, a pressure regulator 146 is positioned downstream of the source 142 and feeds the compressed air to a manifold 148. In an embodiment, a one way valve 150, pressure sensor 152, preferably a wireless pressure sensor, and a pressure relief valve 154 are positioned in line from the manifold 148 to each of the header bladders 118. In this manner, pressure to each header bladder 118 is monitored and relief, for example in the event of over-pressurization, is provided. The various fittings and the like necessary to provide gas-tight connection between the pressurized air source 142 and the bladder inlet, e.g., the fitting 132, will be recognize by those skilled in the art.

A method to prevent the rupture of a tube bundle 12 in a fluid coil 10, which fluid coil 10 has a tube bundle 12 having a series of straight tubing runs 38 and a series of return bends 36 extending between and fluidically connecting ones of the straight tubing runs 38, and an expansion header 28 fluidically connected to at least some of the return bends 36, includes disposing or positioning in the expansion header 28, a polymeric material 46 having an initial shape. The polymeric material 46 is compressible to repeatedly expand and contract between a first volume in which water is present in the tube bundle 12 and a second volume in which the water in the tube bundle 12 undergoes a phase change to ice.

Contraction of the polymeric material 46 absorbs an increase in volume as the water undergoes the phase change to ice so as to prevent stressing and rupture of the tube bundle 12, and, upon a phase change from ice to water, the polymeric material 46 returns to its initial shape.

A suitable polymeric material 46 can be resilient and hydrophobic, and can have a closed cell structure. In methods, the polymeric material 46 has a working temperature in a range of about −40° F. to about 250° F. and a Shore A hardness of about 50 to 90.

In methods, the polymeric material 46 is chemically resistant and non-reactive to chemicals used for corrosion control and microbial control. Suitable polymeric materials 46 include, but are not limited to, an elastomer, a fluorocarbon, a perfluoroelastomer, ethylene-propylene, and tetrafluoroethylene/propylene, and combinations thereof.

In another method, a pressurizable, expandable bladder 118 is positioned in the header 112. The bladder 118 can be a polymeric tube 120, for example an ethylene propylene diene monomer (EPDM) rubber tube 120. The method includes sealing the tube 120 at both ends 122. The tube 120 can be sealed by tube caps 124, such as copper tube caps that are positioned in the tube ends 122 with a clamp 126 positioned on each tube end 122 overlying the tube 120 and the tube cap 124 to seal each end 122. In the method, the tube caps 124 sealed to the tube 120 define an interior pressurizable volume 128.

The method can include sealing one end 129*a* of the header 112 and closing the other end 129*b* of the header 112 by a header cap. The header cap can be, for example, a steel cap, such as a galvanized cap, so as to minimize any galvanic interaction between or among the materials. The method includes enclosing the bladder 118, tube caps 124 and clamps 126 in the header 112 with the header cap 130.

The method further includes pressurizing the bladder 118 through, for example, a fitting 132, such as a gas fitting, that is positioned through the header cap 130 and its adjacent tube cap 124, and extends into the pressurizable volume 128. The method can include mounting the fitting 132 to the tube cap 124 by, for example brazing and the like. The fitting 132 can be, for example, a threaded pipe nipple. Other methods to mount the fitting 132 to the tube cap 124 will be recognized by those skilled in the art. Further, the method can include sealing the fitting 132 at the header cap 130 using a seal 134, such as an O-ring between the tube cap 124 and the header cap 130.

In a method, the bladder 118 is pressurized to a predetermined pressure so that it functions to accommodate the increased volume of ice as the liquid water freezes or undergoes a phase change from water to steam. It is anticipated that the bladder 118 is pressurized or charged to about 120 to about 150 psi so that as the water freezes or undergoes a phase change from water to steam, it expands into the expansion header 112 and pressurizes the bladder 118 externally, in the space between the header 112 and the bladder 118. In this method, the bladder 118 compresses and the pressure in the bladder 118 increases as it accommodate the increase in volume of ice during freezing, and as the ice thaws, the bladder 118 returns to its original volume and pressure by forcing the lower volume water back into the coil assembly 10.

The method can include using a system 140 to pressurize the bladder 118 that includes a source of compressed gas 142 and flow conduits 144 such as tubing between the source 142 and the fitting 132. The method includes regulating the pressure to the bladder 118 downstream of the source 142. The method can further include feeding the compressed air to a manifold 148 and, feeding the compressed air from the manifold 148 to the bladder 118 through a series of valves and other components, such as a one way valve 150, a pressure sensor 152, preferably a wireless pressure sensor, and a pressure relief valve 154. In this manner, the system 140 allows for monitoring the pressure to each header bladder 118, and providing relief, for example in the event of over-pressurization. The method may include other fittings and the like necessary to provide gas-tight connection between the pressurized air source 142 and the bladder 118 inlet, e.g., fitting 132.

It will be appreciated that although the presently disclosed apparatus and method to prevent fluid coils from splitting or rupturing due to the thermal expansion of liquid is described based on a water-based system, such a description is presented as an example only, and that the present apparatus and method may be used in a wide variety of fluid and gaseous systems to prevent coils from splitting or rupturing due to thermal expansion. It will be understood that such other fluid and gaseous systems are within the scope and spirit of the present disclosure.

In the present disclosure, the words "a" or "an" are to be taken to include both the singular and the plural. Conversely, any reference to plural items shall, where appropriate, include the singular. All patents and published applications referred to herein are incorporated by reference in their entirety, whether or not specifically done so within the text of this disclosure.

It will also be appreciated by those skilled in the art that any relative directional terms such as sides, upper, lower, top, bottom, rearward, forward and the like are for explanatory purposes only and are not intended to limit the scope of the disclosure.

From the foregoing it will be observed that numerous modifications and variations can be made without departing from the true spirit and scope of the novel concepts of the present disclosure. It is to be understood that no limitation with respect to the specific embodiments illustrated is intended or should be inferred.

The invention claimed is:

1. A fluid coil comprising:

a tube bundle having a series of straight tubing runs and a series of return bends extending between and fluidically connecting ones of the straight tubing runs;

an expansion header fluidically connected to at least some of the return bends; and a compressible polymeric material disposed in the expansion header, the polymeric material having an initial shape and first volume when water is present in the tube bundle, wherein the polymeric material is configured to contract from the first volume to a second volume when the water undergoes a phase change to prevent stressing and rupture of the tube bundle, wherein the first volume is larger than the second volume, and wherein the polymeric material is configured to expand from the second volume to the first volume and return to the initial shape when the water undergoes an opposite phase change.

2. The fluid coil of claim 1, further including a fin pack.

3. The fluid coil of claim 2, further including support members, wherein the tube bundle and fin pack are mounted within the support members.

4. The fluid coil of claim 1, including a first plurality of return bends on a first side of the tube bundle and a second plurality of return bends on a second side of the tube bundle, the first plurality of tube bends extending between and fluidically connecting ones of the straight tubing runs on the first side of the tube bundle and the second plurality of tube bends extending between and fluidically connecting ones of the straight tubing runs on the second side of the tube bundle.

5. The fluid coil of claim 4, including two expansion headers, a first expansion header fluidically connected to the first plurality of return bends and a second expansion header fluidically connected to the second plurality of return bends.

6. The fluid coil of claim 1, wherein the polymeric material is resilient and hydrophobic.

7. The fluid coil of claim 1, wherein the polymeric material has a closed cell structure.

8. The fluid coil of claim 1, wherein the polymeric material has a working temperature in a range of about −40° F. to about 250° F.

9. The fluid coil of claim 1, wherein the polymeric material has a Shore A hardness of about 50 to 90.

10. The fluid coil of claim 1, wherein the polymeric material is chemically resistant and non-reactive.

11. The fluid coil of claim 10, wherein the polymeric material is chemically resistant and non-reactive to chemicals used for corrosion control and microbial control.

12. The fluid coil of claim 1, wherein the polymeric material is one of an elastomer, a fluorocarbon, a perfluoroelastomer, ethylene-propylene, tetrafluoroethylene/propylene, and/or a combination thereof.

13. A system to prevent the rupture of a tube bundle in a fluid coil, the fluid coil having a tube bundle having a series of straight tubing runs and a series of return bends extending between and fluidically connecting ones of the straight tubing runs, the system comprising:

an expansion header fluidically connected to at least some of the return bends; and a compressible polymeric material disposed in the expansion header, the polymeric material having an initial shape and first volume when water is present in the tube bundle, wherein the polymeric material is configured to contract from the first volume to a second volume when the water undergoes a phase change to prevent stressing and rupture of the tube bundle, wherein the first volume is larger than the second volume, and wherein the polymeric material is configured to expand from the second volume to the first volume and return to the initial shape when the water undergoes an opposite phase change.

14. The system of claim 13, wherein the expansion header is fluidically connected to each of the return bends on a side of the tube bundle.

15. The system of claim 13, wherein the polymeric material is resilient and hydrophobic.

16. The system of claim 13, wherein the polymeric material has a closed cell structure.

17. The system of claim 13, wherein the polymeric material has a working temperature in a range of about −40° F. to about 250° F.

18. The system of claim 13, wherein the polymeric material has a Shore A hardness of about 50 to 90.

19. The system of claim 13, wherein the polymeric material is chemically resistant and non-reactive.

20. The system of claim 19, wherein the polymeric material is chemically resistant and non-reactive to chemicals used for corrosion control and microbial control.

21. The system of claim 13, wherein the polymeric material is one of an elastomer, a fluorocarbon, a perfluoroelastomer, ethylene-propylene, tetrafluoroethylene/propylene, and/or a combination thereof.

22. A method to prevent the rupture of a tube bundle in a fluid coil, the fluid coil having a tube bundle having a series of straight tubing runs and a series of return bends extending between and fluidically connecting ones of the straight tubing runs, and an expansion header fluidically connected to at least some of the return bends, the method comprising:

disposing in the expansion header a compressible polymeric material having an initial shape and first volume when water is present in the tube bundle, the polymeric material being configured to contract from the first volume to and a second volume when the water undergoes a phase change to prevent stressing and rupture of the tube bundle, wherein the first volume is larger than the second volume, and wherein the polymeric material is configured to expand from the second volume to the first volume and return to the initial shape when the water undergoes an opposite phase change.

23. The method of claim 22, wherein the polymeric material is resilient and hydrophobic.

24. The method of claim 22, wherein the polymeric material has a closed cell structure.

25. The method of claim 22, wherein the polymeric material has a working temperature in a range of about −40° F. to about 250° F.

26. The method of claim 22, wherein the polymeric material has a Shore A hardness of about 50 to 90.

27. The method of claim 22, wherein the polymeric material is chemically resistant and non-reactive.

28. The method of claim 27, wherein the polymeric material is chemically resistant and non-reactive to chemicals used for corrosion control and microbial control.

29. The method of claim 22, wherein the polymeric material is one of an elastomer, a fluorocarbon, a perfluoroelastomer, ethylene-propylene, tetrafluoroethylene/propylene, and/or a combination thereof.

* * * * *